US008293192B2

(12) United States Patent
Sakai et al.

(10) Patent No.: US 8,293,192 B2
(45) Date of Patent: Oct. 23, 2012

(54) DISPENSING NOZZLE TIP

(75) Inventors: Ichiro Sakai, Ishioka (JP); Sachio Satoh, Hitachinaka (JP); Hiroaki Sakai, Kasama (JP); Junichi Oizumi, Kasumigaura (JP); Nobuo Suzuki, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 597 days.

(21) Appl. No.: 12/049,559

(22) Filed: Mar. 17, 2008

(65) Prior Publication Data

US 2008/0233013 A1 Sep. 25, 2008

(30) Foreign Application Priority Data

Mar. 20, 2007 (JP) ..... 2007-072868

(51) Int. Cl.
*B01L 3/00* (2006.01)

(52) U.S. Cl. ..... 422/501

(58) Field of Classification Search ..... 422/100
See application file for complete search history.

(56) References Cited

U.S. PATENT DOCUMENTS

| | | | | |
|---|---|---|---|---|
| 3,295,523 | A * | 1/1967 | Weichselbaum | 604/217 |
| 3,938,392 | A * | 2/1976 | Rodrigues | 73/864.11 |
| 5,171,537 | A | 12/1992 | Wainwright et al. | |
| 5,200,151 | A * | 4/1993 | Long | 422/100 |
| 5,851,491 | A | 12/1998 | Moulton | |
| 6,280,689 | B1 * | 8/2001 | Stevens | 422/100 |
| 6,499,363 | B1 | 12/2002 | Morimoto et al. | |
| 2001/0041336 | A1 | 11/2001 | Anderson et al. | |
| 2002/0092367 | A1 | 7/2002 | Bell | |
| 2002/0094302 | A1 | 7/2002 | Taggart et al. | |

FOREIGN PATENT DOCUMENTS

| | | |
|---|---|---|
| EP | 0034438 | 8/1981 |
| EP | 0519390 | 12/1992 |
| EP | 1027932 | 8/2000 |
| EP | 1340545 | 9/2003 |
| EP | 1519196 | 3/2005 |
| JP | 7-284674 A | 10/1995 |

(Continued)

OTHER PUBLICATIONS

Machine translation of "Detailed Description" of JP 07-284674, Oct. 31, 1995.*

*Primary Examiner* — Sam P Siefke
*Assistant Examiner* — Bryan Kilpatrick
(74) *Attorney, Agent, or Firm* — Mattingly & Malur, PC

(57) ABSTRACT

An upper end 3 of a nozzle tip 2 is adapted to have an inside diameter dimension smaller than an outside diameter of a lower portion of a barrel 4, so that nozzle tips 2 are not piled up. An upper curved surface 11, which is curved in an outer direction of the nozzle tip 2 starting with a boundary portion between the barrel 4 and a leading end opening 5 of the nozzle tip 2 and the leading end opening 5, is formed. A lower curved surface 12 is formed continuously from the upper curved surface 11 to be curved in an inner direction. An angle formed between a line tangent to a boundary portion 13 between the upper curved surface 11 and the lower curved surface 12 and a center axis of the nozzle tip 2 is adapted to fall within a range between 45° and 20°.

7 Claims, 6 Drawing Sheets

FOREIGN PATENT DOCUMENTS

| | | | |
|---|---|---|---|
| JP | 9-293816 | A | 11/1997 |
| JP | 2002-204945 | A | 7/2002 |
| JP | 2003-038966 | | 2/2003 |
| JP | 2003-98184 | A | 4/2003 |
| JP | 2003-155644 | A | 5/2003 |
| WO | 2006/092942 | | 9/2006 |

* cited by examiner

DISPENSING NOZZLE TIP

INCORPORATION BY REFERENCE

The present application claims priority from Japanese application JP2007-072868 filed Mar. 20, 2007, the content of which is hereby incorporated by reference into this application.

BACKGROUND OF THE INVENTION

1. Field of the Invention

The present invention relates to a dispensing nozzle tip for a sample such as blood or urine, or a liquid such as water or reagent.

2. Description of the Related Art

The dispensing nozzle tip is connected to a dispensing apparatus and used for aspirating and discharging a liquid. The dispensing nozzle tip typically includes a barrel of a cylindrical shape and a lower leading end of a conical trapezoidal shape with a tapered end.

Because of its very shape, nozzle tips tend to pile up, which hampers automatic loading of the nozzle tip. To prevent this, a known arrangement, as disclosed in JP-A-2003-38966, includes a stopper adapted to have an outside diameter larger than an inside diameter of an opening.

SUMMARY OF THE INVENTION

There is a need the art for enhanced analysis accuracy in analyzing blood, urine, or other samples. This leads to a need for aspiration and discharge of an accurate amount of a liquid sample or reagent.

As described above, the lower leading end of the dispensing nozzle tip has a tapered conical trapezoidal shape. As a result, liquid turbulence caused by channel resistance tends to occur. This is considered to hamper aspiration and discharge of an accurate amount of the liquid sample or the like.

The known art prevents the dispensing nozzle tips from being piled up. No known art has, however, examined the channel resistance at the lower leading end of the nozzle tip.

It is an object of the present invention to achieve a dispensing nozzle tip that prevents dispensing nozzle tips from being piled up and enhances dispensing as well as control accuracy by reducing channel resistance of a liquid in aspiration and discharge of the liquid.

A dispensing nozzle tip according to an aspect of the present invention comprises an upper end, a barrel, and a leading end. Specifically, the upper end has an opening into which the dispensing apparatus is inserted. The barrel is connected to the upper end and accommodates therein a liquid sample or a liquid reagent. The leading end is connected to the barrel and has an opening through which the liquid sample or the liquid reagent is aspirated or discharged. Further, the upper end has an inside diameter smaller than an outside diameter of the barrel. The leading end has an inner surface formed thereon. The inner surface includes an upper curved surface and a lower curved surface. The upper curved surface is curved in an outer direction of the dispensing nozzle tip starting with a boundary portion relative to the barrel. The lower curved surface is formed continuously from the upper curved surface to be curved in an inner direction of the dispensing nozzle tip.

In the dispensing nozzle tip according to another aspect of the present invention, the upper end has an inside diameter smaller than an outside diameter of the barrel. Further, the leading end has an inner surface including a plurality of deflecting ridges formed thereon. The deflecting ridges extend from at least a boundary portion relative to the barrel toward the opening through which the liquid sample or the liquid reagent is aspirated or discharged.

In the dispensing nozzle tip according to still another aspect of the present invention, the upper end has a scrap escape and a fitting portion. The scrap escape has an inside diameter larger than an outside diameter of the dispensing apparatus. The fitting portion has an inside diameter smaller than the inside diameter of the scrap escape and fixedly receives the dispensing apparatus inserted thereinto. Further, the upper end has an inside diameter smaller than an outside diameter of the barrel.

The dispensing nozzle tip according to the aspects of the present invention has the following effects. Specifically, the dispensing nozzle tips can be prevented from being piled up. Channel resistance of a liquid in aspiration and discharge of the liquid can be reduced, so that dispensing as well as control accuracy is enhanced.

DETAILED DESCRIPTION OF THE PREFERRED EMBODIMENTS

A preferred embodiment of the present invention will be described below with reference to the accompanying drawings.

Figure 1:
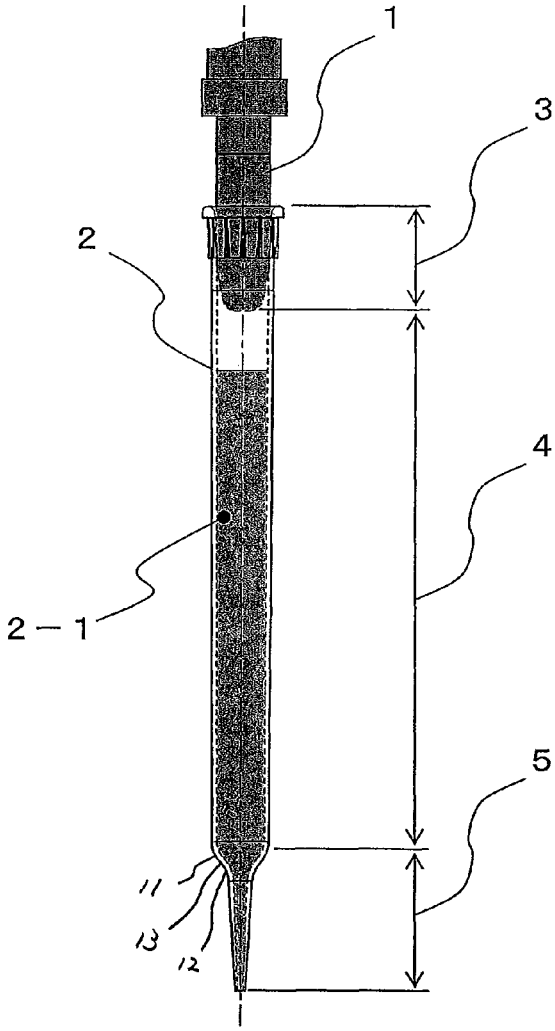
FIG. 1 is a view showing a condition, in which a nozzle tip according to an embodiment of the present invention is loaded in a nozzle tip mount.
Figure 2:
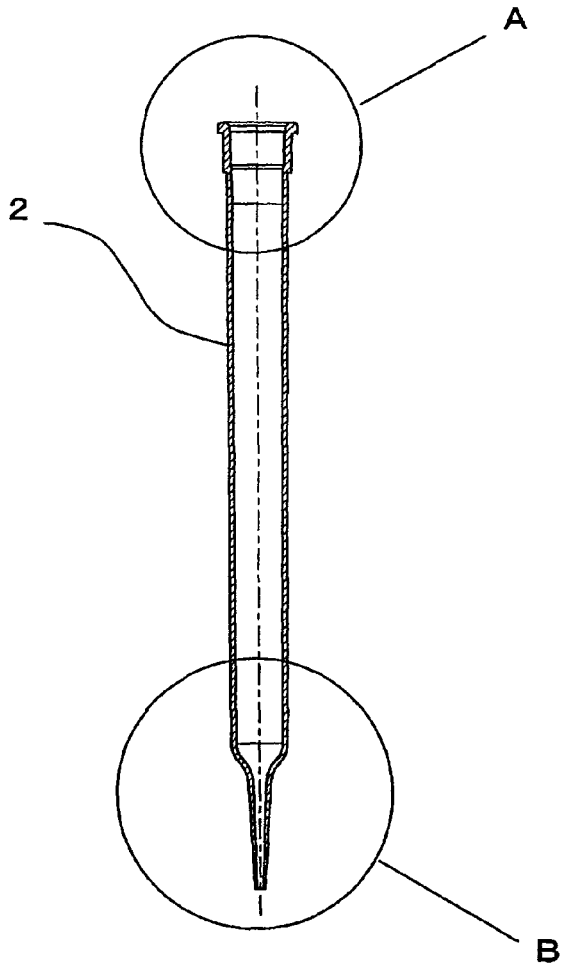
FIG. 2 is a cross-sectional view showing the nozzle tip according to the embodiment of the present invention.
Figure 3:
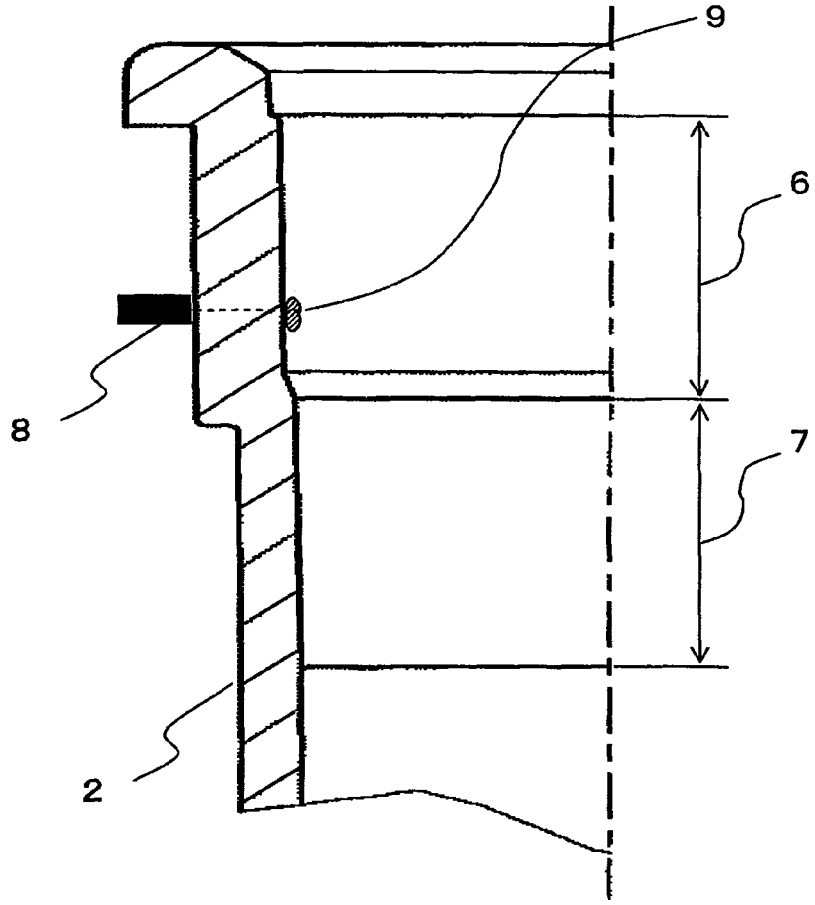
FIG. 3 is a cross-sectional view showing an upper end of the nozzle tip according to the embodiment of the present invention.

FIG. 1 is a view showing a condition, in which a nozzle tip 2 according to the embodiment of the present invention is loaded in a dispensing apparatus nozzle tip mount 1 and a liquid 2-1 is aspirated. FIG. 2 is a cross-sectional view showing the nozzle tip 2 according to the embodiment of the present invention. FIG. 3 is a cross-sectional view showing an upper end of the nozzle tip 2 according to the embodiment of the present invention.

Referring to FIG. 1, the nozzle tip 2 according to the embodiment of the present invention includes an upper end 3, a barrel 4, and a leading end opening 5. The dispensing apparatus nozzle tip mount 1 is inserted and fixed in the upper end 3. The barrel 4 aspirates and holds the liquid 2-1. The leading end opening 5 aspirates and discharges the liquid 2-1.

Referring to FIG. 3, the upper end 3 includes a scrap escape 6 formed therein, relative to insertion of the dispensing apparatus nozzle tip mount 1 into the nozzle tip 2.

A plastic scrap 9 produced during injection molding of the nozzle tip 2 very often attaches to a location near a material injection port 8 used during injection molding.

Accordingly, if the plastic scrap 9 is shaved by the dispensing apparatus nozzle tip mount 1 as the nozzle tip mount 1 is inserted into the upper end 3, the plastic scrap 9 is wedged between the nozzle tip mount 1 and an inner surface of the nozzle tip 2 at a fitting portion 7. This not only impairs airtightness of an inside of the nozzle tip 2, but also reduces fixation performance of the nozzle tip mount 1 in the nozzle tip 2.

The scrap escape 6 is intended to achieve proper airtightness and fixation performance. The scrap escape 6 typically has an inside diameter larger by, for example, 0.2 mm than an outside diameter of the nozzle tip mount 1. This arrangement prevents the nozzle tip mount 1 from moving the plastic scrap 9 onto the fitting portion 7. The scrap escape 6 prevents fitting performance between the nozzle tip mount 1 and the nozzle tip 2 from being degraded, achieving good airtightness during aspiration and discharge.

Figure 4:
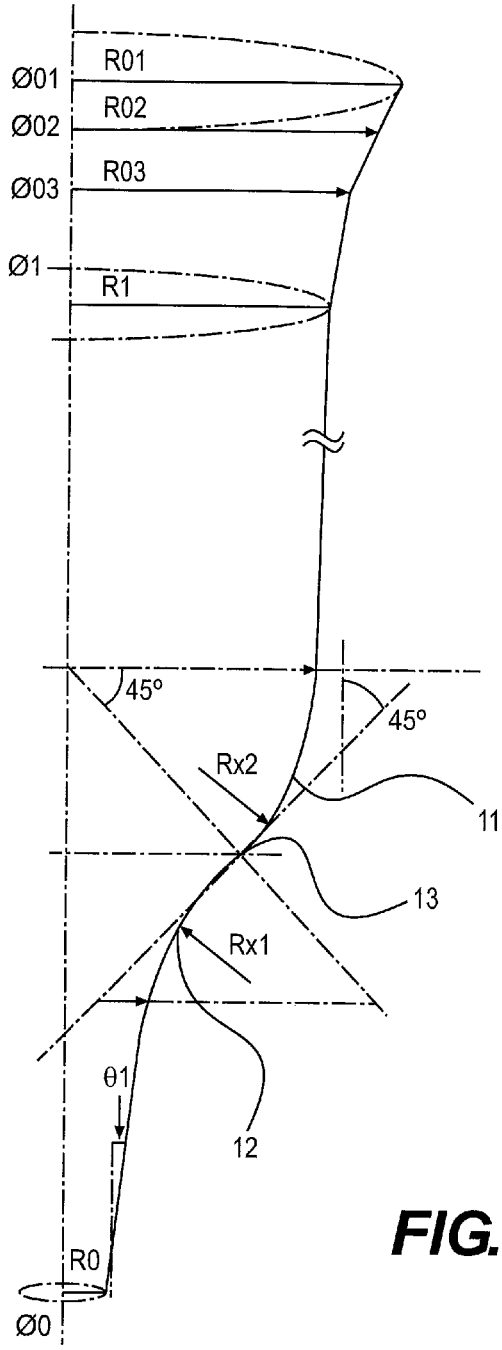
FIG. 4 is a conceptual view showing internal shapes at a boundary portion between a lower portion of a barrel and a leading end opening of the nozzle tip according to the embodiment of the present invention.

FIG. 4 is a conceptual view showing internal shapes at a boundary portion between a lower portion of the barrel 4 and the leading end opening 5 of the nozzle tip 2 according to the embodiment of the present invention.

Referring to FIG. 4, an upper curved surface 11 is formed over an area from the boundary portion between the barrel 4 and the leading end opening 5 of the nozzle tip 2 and the leading end opening 5. The upper curved surface 11 has an outward curvature relative to the nozzle tip 2. The upper curved surface 11 continues into a lower curved surface 12 that has an inward curvature relative to the nozzle tip 2. A line tangent to a boundary portion 13 (a point at which the outward curvature changes to the inward curvature) between the upper curved surface 11 and the lower curved surface 12 extends at an angle of 45° to 20° relative to a center axis of the nozzle tip 2.

An extension from an end point of the lower curved surface 12 is straight toward the leading end.

As such, the leading end opening 5 has an inner surface that includes a stepless curved surface and a straight surface. This prevents turbulence from occurring in a liquid stream in aspiration and discharge of the liquid 2-1 shown in FIG. 1, thereby enhancing dispensing accuracy.

If the angle formed between the line tangent to the boundary portion 13 and the center axis of the nozzle tip 2 is about 45° as shown in FIG. 4 with an overall length of the nozzle tip 2 and a length and an inside diameter of the leading end opening 5 defined, the barrel 4 can have a maximum possible length, achieving a maximum possible amount of liquid to be aspirated.

A quadratic curve of an arc or the like, an exponent function, a streamline shape, or the like is applicable to the shape of the curved surfaces 11, 12.

The volume of the liquid 2-1 shown in FIG. 1 can be measured by measuring the height of the liquid level from the outside, if the barrel 4 of the nozzle tip 2 shown in FIG. 1 is adapted to have an inside diameter dimension that is as identical as possible throughout (by minimizing inclination).

Further, the upper end 3 of the nozzle tip 2 shown in FIG. 1 has an inside diameter dimension smaller than an outside diameter of a lower portion of the barrel 4 of the nozzle tip 2. This prevents the nozzle tip 2 from being piled up.

Figure 5:
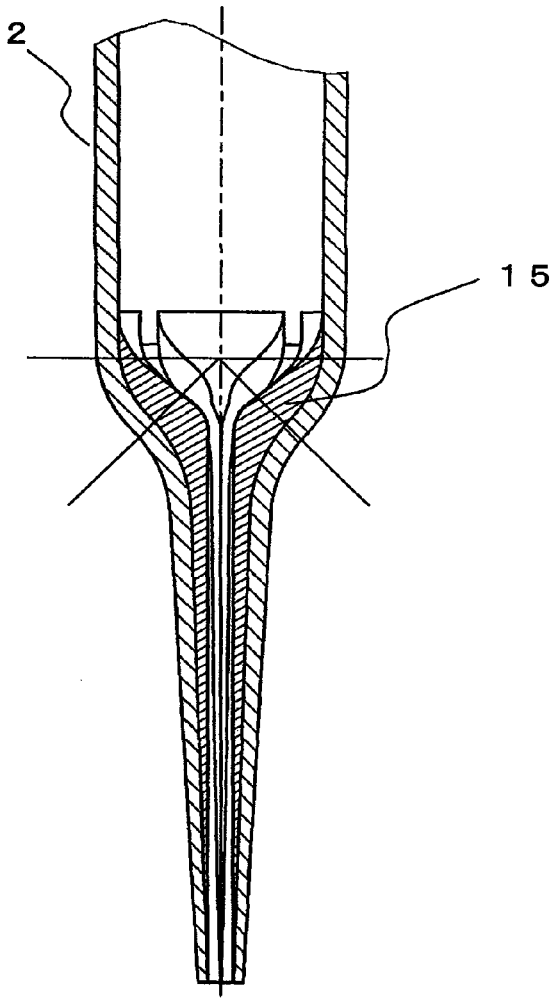
FIG. 5 is a cross-sectional view showing the lower portion of the barrel and the leading end opening of the nozzle tip according to the embodiment of the present invention.
Figure 6:
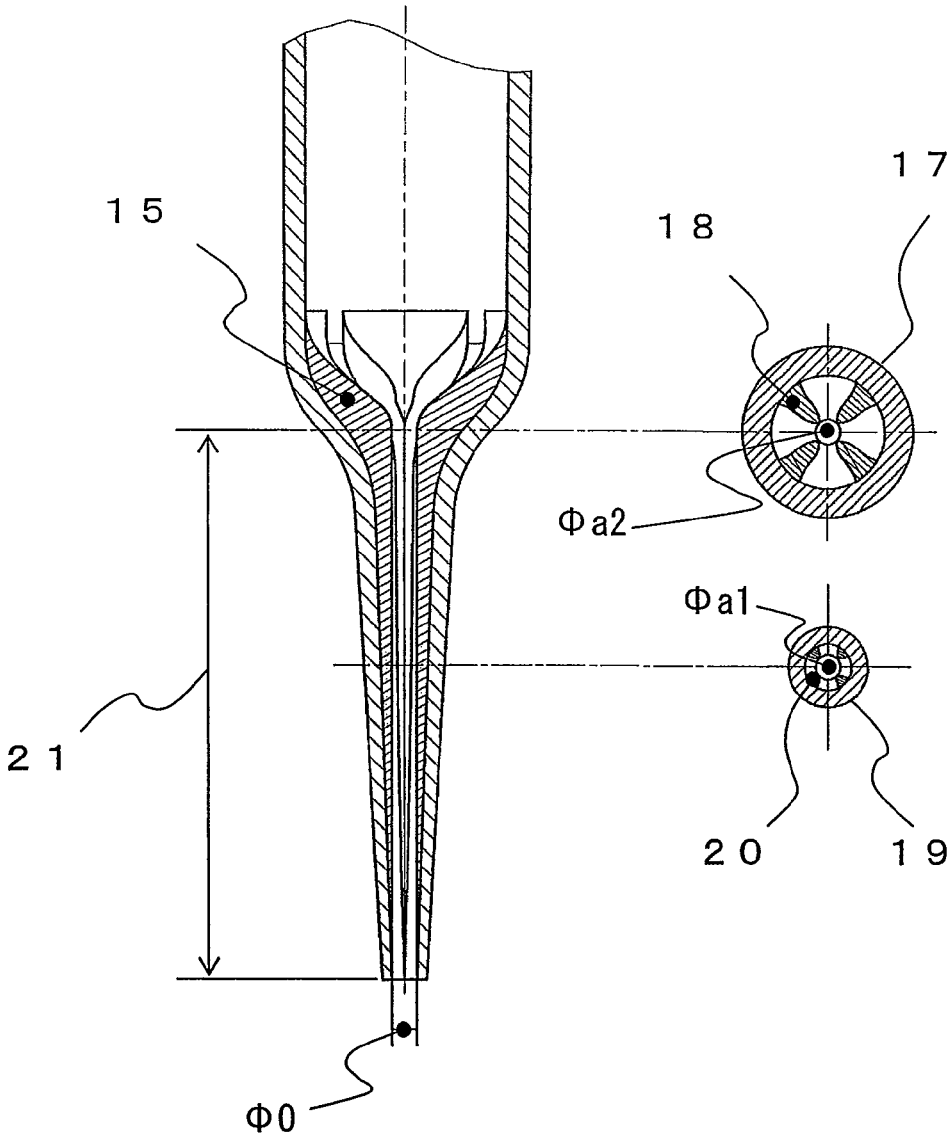
FIG. 6 is a cross-sectional view showing the internal construction of the barrel and the leading end opening.

FIG. 5 is a cross-sectional view showing the lower portion of the barrel 4 and the leading end opening 5 of the nozzle tip 2. FIG. 6 is a cross-sectional view showing the internal construction of the barrel 4 and the leading end opening 5.

Referring to FIG. 5, a deflecting ridge 15 is formed on an inner surface of the nozzle tip 2 shown in FIG. 1. This arrangement allows turbulence of the liquid stream during aspiration and discharge of the liquid 2-1 shown in FIG. 1 to be further prevented.

The deflecting ridge 15 is formed on an area ranging from the end of the barrel 4 to a location near an opening end of the leading end opening 5. In the example shown in FIG. 6, four deflecting ridges 15 are formed, each being equally spaced apart from each other. Each of these four deflecting ridges 15 does not contact each other on the center axis of the nozzle tip 2.

Referring to FIG. 6, a thickness 17 of a curved surface joint (a joint between the barrel 4 and the leading end opening 5), a thickness 18 of the deflecting ridge 15 formed in number at least 3, and a thickness 20 of a dispensing opening (the straight portion in the leading end opening 5) and the deflecting ridges 15 are adjusted, so that an opening diameter at an identical diameter opening portion 21 of FIG. 6 is approximated to a leading end inside diameter 19 of the leading end opening 5 of the nozzle tip 2 shown in FIG. 1. This allows micro foreign matter mixed with the liquid, which is not currently detectable, to be detected.

Specifically, forming the deflecting ridge 15 allows foreign matter trapped in the nozzle tip 2 to be retained by the deflecting ridge 15. This causes an aspiration pressure to fluctuate, which allows trap of the foreign matter to be detected.

Preferably, the deflecting ridge 15 in the identical diameter opening portion 21 should have a total cross-sectional area of 30% or more of a cross-sectional inside diameter area of the nozzle tip 2. As long as this requirement is satisfied, the deflecting ridge 15 is not limited in number to 4.

The height of deflecting ridge 15 can be assumed more than the diameter of $\phi 0<\phi a1<\phi a2$ shown in FIG. 6 leading end opening 5.

As described heretofore, the dispensing nozzle tip 2 according to the embodiment of the present invention is constructed so as to prevent the dispensing nozzle tip 2 from being piled up through the arrangement, in which the upper end 3 has an inside diameter dimension smaller than the outside diameter dimension of the lower portion of the barrel 4 of the nozzle tip 2. Further, the barrel 4 and the leading end opening 5 are joined together through a curved surface, so that no turbulence occurs in the liquid stream that would otherwise occur during aspiration and discharge of the liquid. The nozzle tip 2 according to the embodiment of the present invention can thereby stabilize the liquid stream.

The upper end 3, into which the dispensing apparatus nozzle tip mount 1 is inserted, includes the scrap escape 6 formed thereon. This helps prevent adhesion properties from being degraded, as caused by scrap left in a gate during manufacturing of the nozzle tip.

In addition, during the manufacture of the nozzle tip, the barrel 4 is made to have an inside diameter dimension resulting in a cylindrical shape as much as possible. This allows the volume of the liquid contained in the nozzle tip to be detected by detecting the level of the liquid from the outside.

Further, the arrangement, in which the deflecting ridge 15 is formed on the inside of the leading end opening 5, helps suppress turbulence in the liquid stream. The deflecting ridge 15 is also adapted to have an inside diameter equal to the dimension of the dispensing opening. This allows foreign matter trapped in the liquid to be detected as clogged aspiration.

What is claimed is:

1. A dispensing nozzle tip for dispensing a liquid sample or a liquid reagent by means of a dispensing apparatus, the dispensing nozzle tip comprising:

an upper end portion having an opening into which the dispensing apparatus is inserted;

a barrel portion connected to the upper end portion, the barrel portion accommodating therein the liquid sample or the liquid reagent;

a leading end portion connected to the barrel portion, the leading end portion having an opening through which the liquid sample or the liquid reagent is aspirated or discharged; and a connection portion connecting the leading end portion and the barrel portion;

wherein the upper end portion has an inside diameter smaller than an outside diameter of the barrel portion;

wherein an inner surface of the connection portion consists of an upper curved surface and a lower curved surface that are smoothly and continuously directly connected to each other, wherein the upper curved surface extends in an outwardly curved surface relative to the nozzle tip from the barrel portion to an inner side of the dispensing nozzle tip;

wherein the lower curved surface extends in an inwardly curved surface relative to the nozzle tip from the upper curved surface to the leading end portion and is smoothly and continuously connected with the leading end portion; and wherein an angle formed between a line tangent to a boundary portion between the upper curved surface and the lower curved surface of the leading end portion and a center axial axis of the dispensing nozzle tip is 45° or less.

2. The dispensing nozzle tip according to claim 1, wherein the upper end portion has an inside diameter smaller than an outside diameter of the barrel portion; and wherein the leading end portion has an inner surface including a plurality of deflecting ridges formed thereon, the deflecting ridges extending from at least a boundary portion relative to the barrel portion toward the opening through which the liquid sample or the liquid reagent is aspirated or discharged.

3. The dispensing nozzle tip according to claim 1, wherein the upper end portion has a scrap escape having an inside diameter larger than an outside diameter of the dispensing apparatus and a fitting portion having an inside diameter smaller than the inside diameter of the scrap escape and fixedly receiving the dispensing apparatus inserted therein.

4. The dispensing nozzle tip according to claim 3, wherein the leading end portion has an inner surface formed thereon, including an upper curved surface and a lower curved surface, the upper curved surface being curved in an outer direction of the dispensing nozzle tip starting with a boundary portion relative to the barrel portion and the lower curved surface being formed continuously from the upper curved surface to be curved in an inner direction of the dispensing nozzle tip; and wherein the leading end portion has an inner surface including a plurality of deflecting ridges formed thereon, the deflecting ridges extending from at least a boundary portion relative to the barrel portion toward the opening through which the liquid sample or the liquid reagent is aspirated or discharged.

5. The dispensing nozzle tip according to claim 1, wherein the upper curved surface and the lower curved surface of the leading end portion are formed according to an exponential function curve; and wherein an angle formed between a line tangent to a boundary portion between the upper curved surface and the lower curved surface of the leading end portion and a center axial axis of the dispensing nozzle tip falls within a range between 45° and 20°.

6. The dispensing nozzle tip according to claim 1, wherein the barrel portion is substantially a cylindrical shape.

7. The dispensing nozzle tip according to claim 2, wherein the deflecting ridges have a height more than a diameter of the opening of the leading end portion.

* * * * *